US012798727B2

(12) United States Patent
Antonsen et al.

(10) Patent No.: US 12,798,727 B2
(45) Date of Patent: Nov. 17, 2026

(54) METHOD FOR TRIPLE TENSIONING OF A MOORING SYSTEM WITH ANCHORS ON A SEABED

(71) Applicant: KONGSBERG MARITIME AS, Kongsberg (NO)

(72) Inventors: Ottar Antonsen, Kongsberg (NO); Martijn De Jongh, Mariefred (SE); Lars Petter Tennfjord, Ålesund (NO)

(73) Assignee: KONGSBERG MARITIME AS, Kongsberg (NO)

( * ) Notice: Subject to any disclaimer, the term of this patent is extended or adjusted under 35 U.S.C. 154(b) by 154 days.

(21) Appl. No.: 18/873,124

(22) PCT Filed: Jun. 7, 2023

(86) PCT No.: PCT/NO2023/050132
§ 371 (c)(1),
(2) Date: Dec. 9, 2024

(87) PCT Pub. No.: WO2023/239244
PCT Pub. Date: Dec. 14, 2023

(65) Prior Publication Data

US 2025/0360987 A1 Nov. 27, 2025

(30) Foreign Application Priority Data

Jun. 8, 2022 (NO) ..... 20220653

(51) Int. Cl.
*B63B 21/50* (2006.01)
*B63B 21/16* (2006.01)
(Continued)

(52) U.S. Cl.
CPC ..... *B63B 21/502* (2013.01); *B63B 21/16* (2013.01); *B63B 21/18* (2013.01); *B63B 21/22* (2013.01); *B63B 21/50* (2013.01)

(58) Field of Classification Search
CPC ..... B63B 21/16; B63B 21/18; B63B 21/22; B63B 21/50; B63B 21/502
See application file for complete search history.

(56) References Cited

U.S. PATENT DOCUMENTS 4,604,961 A * 8/1986 Ortloff ..... B63B 21/50 441/4
2015/0210361 A1* 7/2015 Robertsson ..... B63B 21/508 441/3
2019/0233058 A1 8/2019 Lane et al.

FOREIGN PATENT DOCUMENTS

WO WO-2020040646 A1 * 2/2020 ..... B63B 21/50

OTHER PUBLICATIONS

WIPO/ISA/XN, International Search Report and Written Opinion issued in corresponding International Application No. PCT/NO2023/050132 on Aug. 11, 2023, 8 pages.
(Continued)

*Primary Examiner* — Richard G Davis
(74) *Attorney, Agent, or Firm* — J. Peter Paredes; Amin Wasserman Gurnani LLP

(57) ABSTRACT

A method for triple tensioning of a mooring system with anchors on a seabed, in where a vessel (6) comprises one or more moonpools (1) having a through running vertical channel with an upper moonpool opening in proximity to a deck of the vessel (6), and a bottom moonpool opening open to surrounding sea, said moonpool (1) comprises one or more chain stoppers (5), and the vessel (6) further comprising one or more tensioning winches (2), one or more chain handling winches (3), and one or more abandon and recovery winches (4).

13 Claims, 7 Drawing Sheets

(51) Int. Cl.
*B63B 21/18* (2006.01)
*B63B 21/22* (2006.01)

(56) References Cited

OTHER PUBLICATIONS

Norwegian Intellectual Property Office, Norwegian Search Report issued in corresponding Norwegian Patent Application No. 20220653 on Oct. 26, 2022, 2 pages.
Norwegian Intellectual Property Office, Examination Report issued in corresponding Norwegian Patent Application No. 20220653 on Oct. 28, 2022, 4 pages.
Vryhof, Product Brochure—Stevtensioner Enabling Installations, see under "3-way tension" on p. 4, Apr. 2017 [https://insights.vryhof.com/download-the-stevtensioner-product-brochure], 6 pages.

* cited by examiner

METHOD FOR TRIPLE TENSIONING OF A MOORING SYSTEM WITH ANCHORS ON A SEABED

FIELD OF THE INVENTION

The present invention relates to a method for triple tensioning of a mooring system with anchors on a seabed, in where a vessel comprises one or more moonpools having a through running vertical channel with an upper moonpool opening in proximity to a deck of the vessel, and a bottom moonpool opening open to surrounding sea, said moonpool comprises one or more chain stoppers, and the vessel further comprising one or more tensioning winches, one or more chain handling winches, and one or more abandon and recovery winch.

DISCLOSURE OF THE STATE OF ART

Known technique is for instance the "Stevtensioner" by Vryhof. The Stevtensioner® is basically a chain shortening clutch with the mooring chain connected on one side and a reaction chain running through it. A vertical pull can induce more than double that pull in the horizontal leg. Repeatedly heaving up and slacking the Stevtensioner® in a yo-yo action builds up the load in the mooring chain until the required tension is achieved. Typically, 5-7 cycles are sufficient.

The Stevtensioner® requires chain all the way, as the tensioner slides down the line and could possibly damage a rope.

WO 2020/040646 A1 discloses a mooring tensioning arrangement on a vessel, comprising a moonpool having a through running vertical channel with an upper moonpool opening in proximity to a deck of the vessel, and a bottom moonpool opening open to surrounding sea. A winch is located above the moonpool, wherein a first anchor wire pennant runs from the winch, over a stern of the vessel and into sea, and a second anchor wire pennant runs from the winch, through the moonpool and into the sea.

OBJECTS OF THE PRESENT INVENTION

It is understood that triangle shaped Floating installation is the most attractive way moving forward with Floating Wind Installation. Depending on the size of the Floater, it will have one or more anchors in each corner (approximately 120 degrees angle distance). The object is to do "Proof Loading" of three anchors in one operation, by one vessel.

Benefits compared to already known technique is more efficient way of doing "Proof Load"—testing. No need of a reaction anchor—saves time and cost. Safer operation—by use of one vessel compared to three (narrow space).

An advantage with the present invention is that all anchor lines are connected to a winch on the vessel, which gives the possibilities and flexibilities to adjust the length of the anchor lines during tensioning. If any of the anchor lines are "de-tensioned", the tension can be adjusted.

The present invention also provides time saving hook-up and disconnection operations.

Proof loading is done on all three anchors at the same time. The point of doing proof loading is to follow regulations by testing the anchors at a given load for at least 15-30 min. to be sure that they are anchored properly.

Floating wind installations require substantially higher loads than oil and gas. For instance, within oil and gas about 300 tons has been the standard. However, floating wind installations may use larger drag anchors which are to be test-tensioned up to for instance 800 tons.

Furthermore, the present invention may also suit the removing of inverse catenaries for suction anchors with mooring lay-out same as for drag-embedment anchor.

The invention is not limited to drag-anchors, but may also be suitable for suction anchors/pile anchors, etc.

SUMMARY OF THE INVENTION

According to the invention, a method for tensioning of a mooring system with anchors on a seabed is provided, in where a vessel comprises one or more moonpools having a through running vertical channel with an upper moonpool opening in proximity to a deck of the vessel, and a bottom moonpool opening open to surrounding sea, said moonpool comprises one or more chain stoppers, and the vessel further comprising one or more tensioning winches, one or more chain handling winches, and one or more abandon and recovery winches, wherein the method comprises the steps:

a) deploying a first anchor line with a proof loading chain connected to a first anchor on a first location on the seabed, said anchor is deployed from the stern of the vessel and embedded in the seabed using bollard pull from the vessel, b) deploying a second anchor line with a proof loading chain connected to a second anchor on a second location and deploying a third anchor line with a proof loading chain connected to a third anchor on a third location, by repeating step a), c) moving the vessel to pick up the second anchor line and the third anchor line through the moonpool of the vessel, while the first anchor line is connected to the tensioning winch and runs over the stern of the vessel, d) on the location for picking up the second anchor line;
   - deploying a pick-up wire with a connectable hook through the moonpool from the abandon and recovery winch,
   - connecting the pick-up wire to the proof loading chain from the anchor,
   - recovering the pick-up wire with the proof loading chain through the moonpool and engaging the chain stopper to take over the load from the proof loading chain, and
   - connecting the proof loading chain with a chain from the chain handling winch, e) moving the vessel to the location for picking up the third anchor line, and repeating step d) for the third anchor line, f) tensioning the first anchor line to tension all three proof loading chains of the three anchor lines, g) performing a proof loading test of the three-legged mooring system, and h) using the chain handling winch to adjust both in and out on the proof loading chains, in case of uneven embedding/tension on the anchors.

The anchors can be embedded on the seabed using bollard pull from the vessel, or the anchors can be embedded on the seabed using the tensioning winch, or a combination thereof.

The anchors are preferably installed with a bottom chain which is connected to the proof loading chain with a chain link.

After the first anchor is embedded on the seabed, an initial embedding test can be performed.

The proof loading test of the three-legged mooring system can be performed using final tensioning of forces up to 800 te.

The proof loading test of the three-legged mooring system can be performed using final tensioning of forces of 800 te or more.

The anchors can be deployed in their respective target box and aligned with a respective mooring line corridor.

In step d) of the method, the proof loading chain can be recovered up through the moonpool until the first chain links are through the chain stopper, thereafter the chain stopper is engaged and is taking over the load from the chain catenary of the proof loading chain, and the connection hook is disconnected.

The extra length of proof loading chain can be held in a chain locker, and said chain is routed from the locker through the chain handling winch and down towards the proof loading chain in the chain stopper, hereafter the chain from the locker is connected with the proof loading chain using a chain link.

When performing tensioning, the vessel can move closer towards the anchor which is connected to the tensioning winch, and all three proof loading chains are aligning towards their respective target boxes.

The mooring system can be a three-legged mooring system with three anchors on the seabed.

The method for tensioning the mooring system can be repeated for a six-legged mooring system, with for instance six anchors on the seabed.

The anchors on the seabed can be placed with approximately 118-122 deg spread, preferably approximately a 120 deg spread.

DESCRIPTION OF THE FIGURES

Embodiments of the present invention will now be described, by way of example only, with reference to the following figures, wherein.

DESCRIPTION OF PREFERRED EMBODIMENTS OF THE INVENTION

Parts List in the Figures

Figure 1:
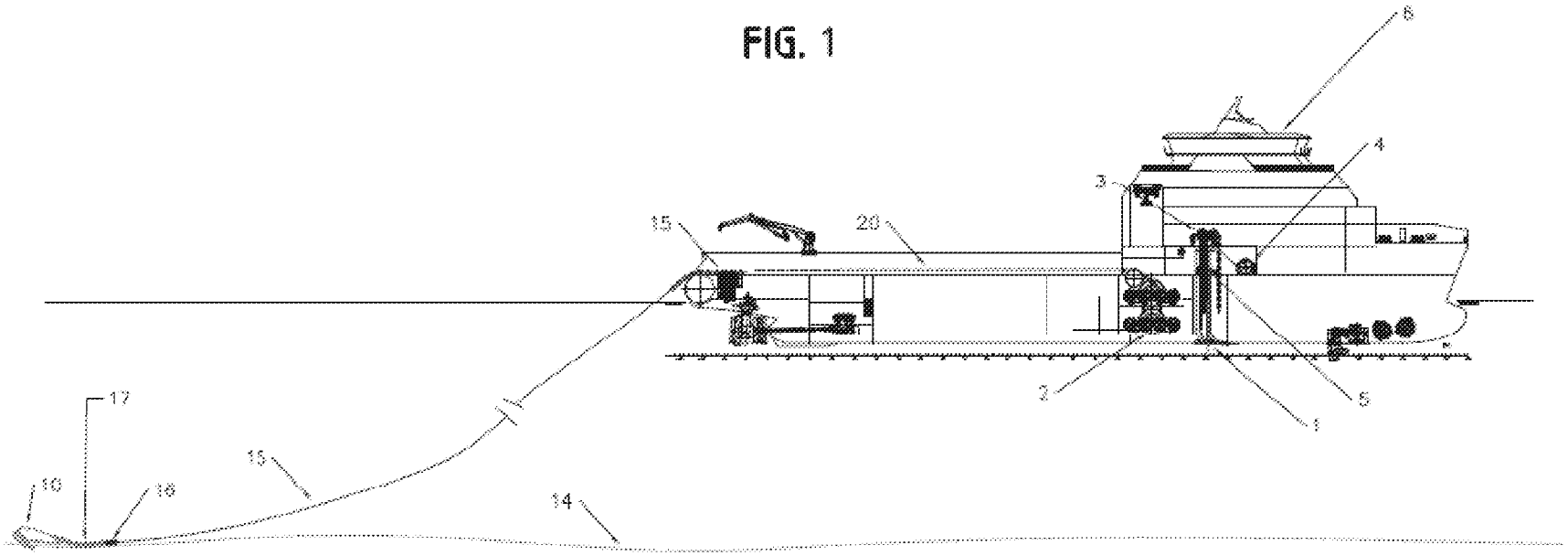
FIG. 1 shows a first step in the triple tensioning according to the invention.
Figure 2:
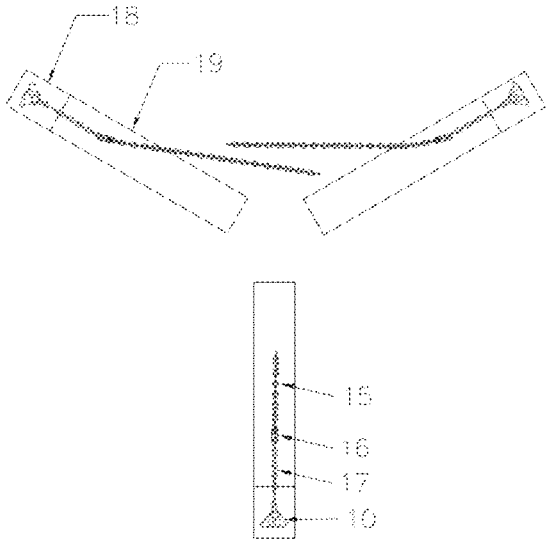
FIG. 2 shows that after the initial embedding of the first anchor line, the two other anchor lines are deployed.
Figure 3:
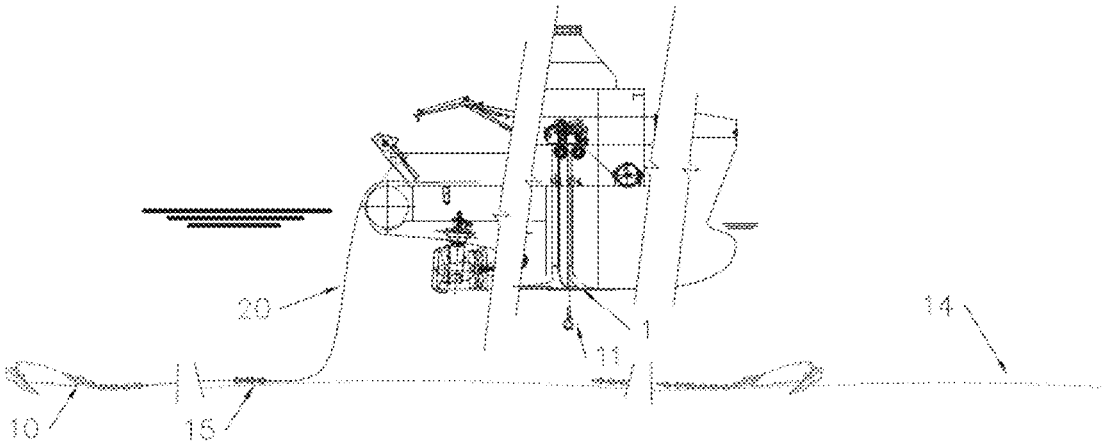
FIG. 3 shows that at the location for pick-up of the first anchor line through the moonpool, the abandon and recovery winch deploy its wire with a connectable hook through the moonpool.
Figure 4:
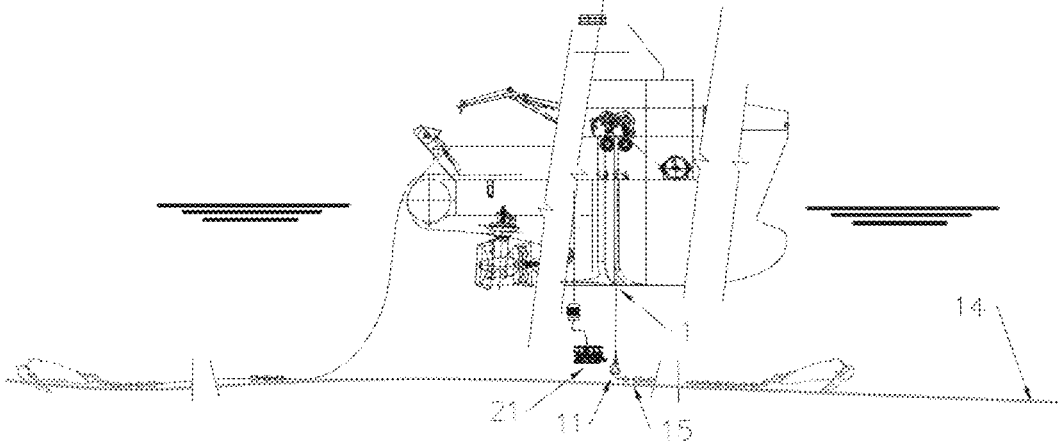
FIG. 4 shows that the wire and the connectable hook 11 is at the seabed and in vicinity of the proof loading chain for the anchor.
Figure 5:
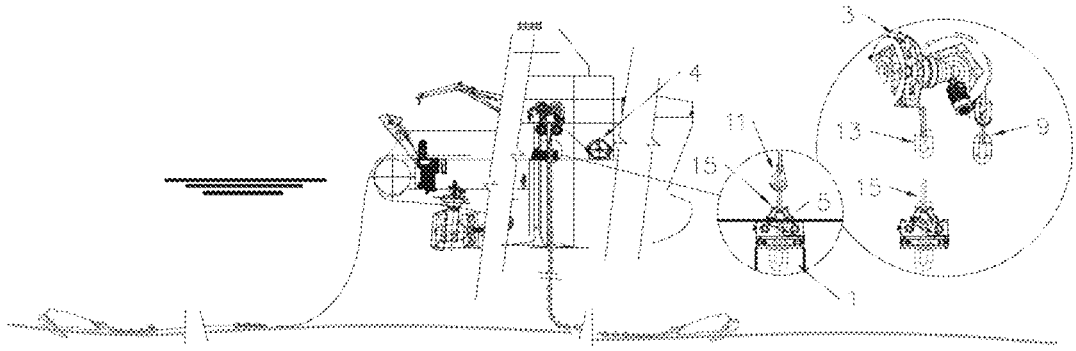
FIG. 5 shows recovery of the wire and the proof loading chain through the moonpool.
Figure 6:
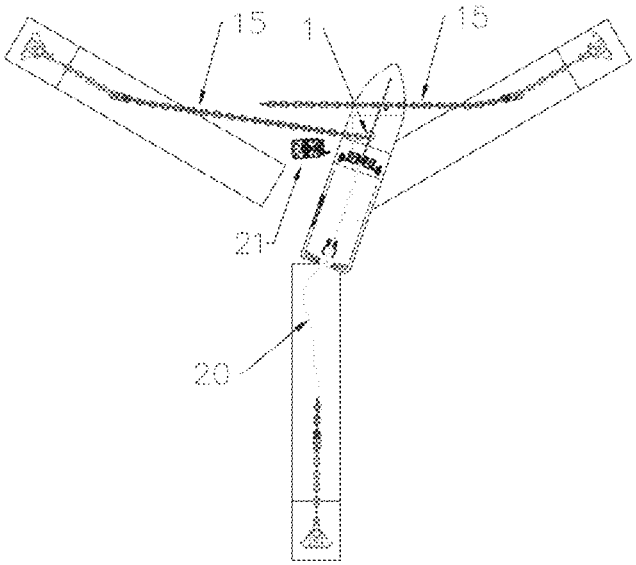
FIG. 6 shows movement of the vessel to pick-up points for picking up the two other anchor lines.
Figure 7:
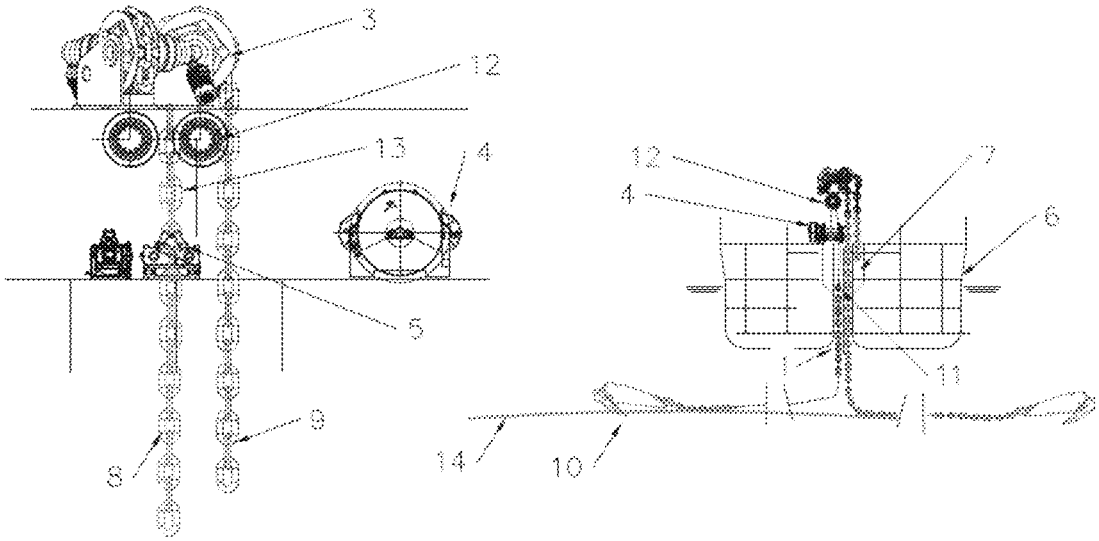
FIG. 7 shows recovery of the proof loading chain.

1—moonpool(s)
2—tension winch
3—chain handling winches
4—abandon & recovery (A & R) winch
5—chain stoppers
6—vessel
7—chain locker
8—chain from anchor
9—chain to locker
10—drag embedment anchor
11—ROV operated hook
12—sheave for A & R winch
13—chain to chain connection
14—seabed
15—proof load chain
16—chain link
17—bottom chain
18—anchor target box
19—mooring line target box
20—wire from tensioning winch
21—work remote operated vehicle (WROV)

FIG. 1

First step in triple tensioning is that vessel 6 conducts installation of the first drag embedded anchor 10. The vessel 6 deploys the anchor 10 from stern of the vessel 6 and lands it on the seabed 14. The anchor 10 is installed with its bottom chain 17 which is connected to a proof loading chain 15 with a chain link 16 of any type. The first anchors are embedded using bollard pull from vessel 6, typically 150-300 te, but may be embedded on the seabed 14 using the tensioning winch 2, or a combination thereof. This is called an initial embedding. The purpose is to ensure that the anchor 10 is embedding and is prepared for the final tensioning to forces up to for instance 800 te.

The vessel 6 comprises at least: a tensioning winch 2, one or more moonpools 1, chain handling winches 3, chain stoppers 5 and abandon and recovery winch 4.

FIG. 2

After the initial embedding of first anchor line, the two other anchor lines are deployed using same method.

The anchors are deployed in their respective target box 18 and aligned with the respective mooring line corridor 19. This is the configuration on the seabed prior to hook up all anchor lines to the vessel.

The first anchor line that is embedded with the initial test, could stay connected to the vessel 6 and the tensioning winch 2, while the vessel is moving towards the two other anchor lines for recovery through the moonpools 1.

FIG. 3

To accommodate the vessel move, the tensioning winch pays out its wire 20.

Once at location for pick-up of the first anchor line through the moonpool, the abandon and recovery winch 4 deploy its wire with a ROV connectable hook 11 through the moonpool 1.

FIG. 4

Once the wire and ROV connectable hook 11 from the abandon and recovery winch 4 is at the seabed and in vicinity of the proof loading chain 15 for the anchor 10, the ROV 21 can perform connection and prepare for recovery of the anchor line back to the vessel 6.

FIG. 5

The abandon and recovery winch 4 recover its wire and the proof loading chain 15 up through the moonpool 1, until the first chain links are through the chain stopper 5. The chain stopper 5 is then engaged and is now taking the load from the chain catenary of the proof loading chain 15.

The ROV connection hook 11 is now disconnected. Extra length of proof loading chain is held in a chain locker 7,9. This chain is routed from the locker 7 through the chain handling winch 3 and down towards the proof loading chain 15 in the chain stopper 5. The chain from the locker 7 is now connected with the proof loading chain 15 using a chain link 13. The chain handling winch 3 makes it now possible to adjust both in and out on the proof loading chain 15, in case of uneven embedding/tension on the anchors 10.

FIG. 6

The vessel 6 with tension winch 2 wire 20 connected to first anchor, is moving towards pick-up point of the two remaining proof loading chains 15.

The vessel 6 will be in position to recover one anchor line at a time through the moonpool 1 using the abandon and recovery winch 4.

FIG. 7

Figure 8:
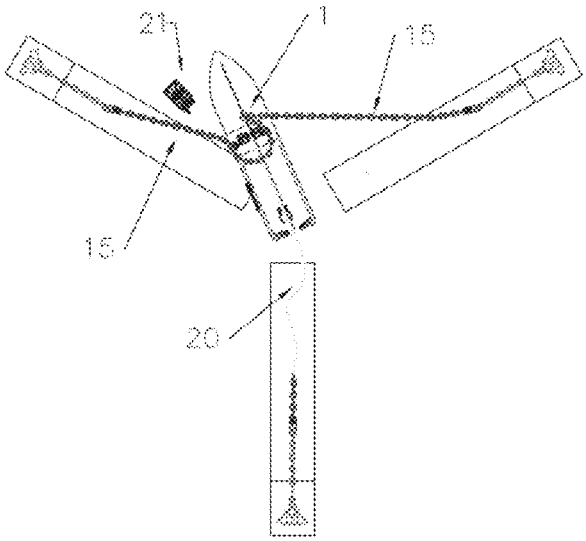
FIG. 8 shows recovery of the third proof loading chain connected to the third anchor.
Figure 9:
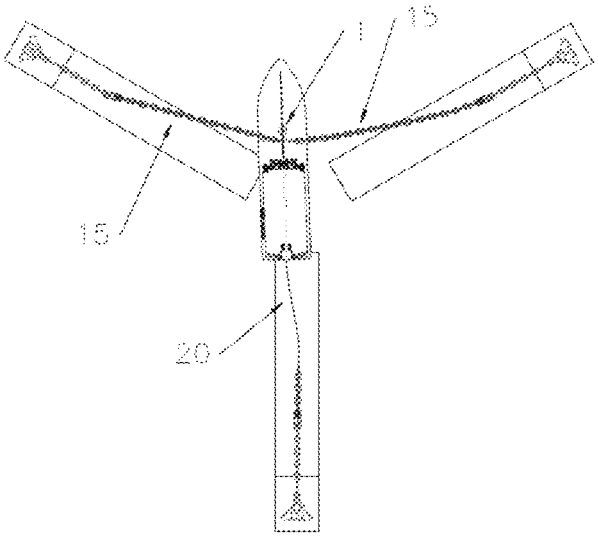
FIG. 9 shows that the vessel moves closer towards the anchor, which is connected to the tensioning winch, when performing tensioning.
Figure 10:
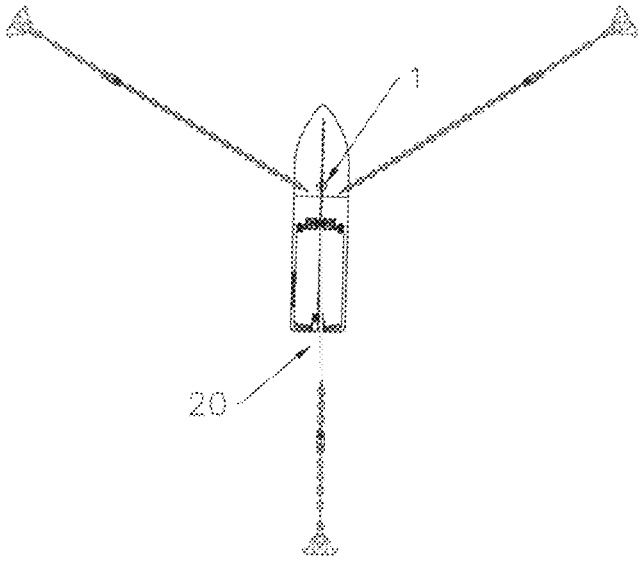
FIG. 10 shows the configuration during final proof load test off a three-legged mooring system.
Figure 11:
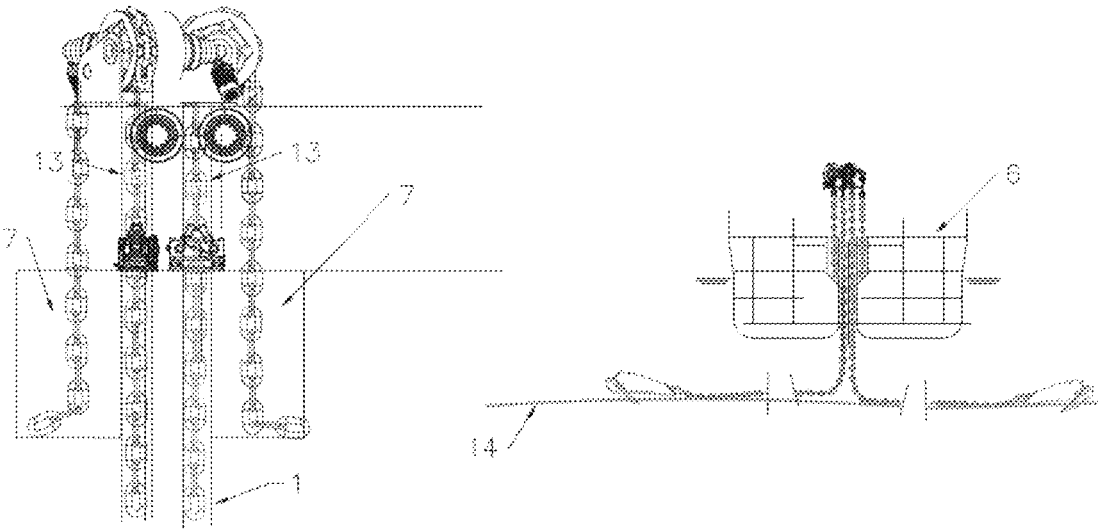
FIG. 11 shows the configuration onboard the vessel during final proof loading of all three anchors.

The second proof loading chain 15 is recovered using same methodology. FIG. 8.

The third proof loading chain 15 connected to the third anchor 10 is recovered to the vessel 6 through the moonpool 1. All three proof loading chains 15 are now recovered to the vessel 6 and the final prof loading of the anchors can commence. This will be performed by paying inn on the wire 20 using the tensioning winch 2.

FIG. 9

When performing tensioning, the vessel 6 moves closer towards the anchor 10 which is connected to the tensioning winch 2. All three proof loading chains are starting to align towards its respective target boxes 19.

FIG. 10

This figure indicates the configuration during final proof load test off a three-legged mooring system.

FIG. 11

The configuration onboard vessel 6 during final proof loading of all three anchors 10.

The chain handling winches 3 makes it possible to adjust the length of the chains in cases of uneven embedding or tension in the lines. Extra length of proof loading chain is stored in the chain locker 7 onboard the vessel 6.

The method according to the invention is disclosed used with a three-legged mooring system. However, the method may also be used in for instance a six-legged mooring system with six anchors 10 on the seabed 14, simply by repeating the operation twice.

The invention claimed is:

1. A method for tensioning of a mooring system with anchors on a seabed, in where a vessel (6) comprises one or more moonpools (1) having a through running vertical channel with an upper moonpool opening in proximity to a deck of the vessel (6), and a bottom moonpool opening open to surrounding sea, said moonpool (1) comprises one or more chain stoppers (5), and the vessel (6) further comprising one or more tensioning winches (2), one or more chain handling winches (3), and one or more abandon and recovery winches (4), wherein the method comprises the steps:

a) deploying a first anchor line with a proof loading chain (15) connected to a first anchor (10) on a first location on the seabed (14), said anchor (10) is deployed from the stern of the vessel (6) and embedded in the seabed (14) using bollard pull from the vessel (6), b) deploying a second anchor line with a proof loading chain (15) connected to a second anchor (10) on a second location and deploying a third anchor line with a proof loading chain (15) connected to a third anchor (10) on a third location, by repeating step a), c) moving the vessel (6) to pick up the second anchor line and the third anchor line through the moonpool (1) of the vessel (6), while the first anchor line is connected to the tensioning winch (2) and runs over the stern of the vessel, d) on the location for picking up the second anchor line;

deploying a pick-up wire with a connectable hook (11) through the moonpool (1) from the abandon and recovery winch (4), connecting the pick-up wire to the proof loading chain (15) from the anchor (10), recovering the pick-up wire with the proof loading chain (15) through the moonpool (1) and engaging the chain stopper (5) to take over the load from the proof loading chain (15), and connecting the proof loading chain (15) with a chain from the chain handling winch (3), e) moving the vessel (6) to the location for picking up the third anchor line, and repeating step d) for the third anchor line, f) tensioning the first anchor line to tension all three proof loading chains of the three anchor lines, g) performing a proof loading test of the three-legged mooring system, and h) using the chain handling winch (3) to adjust both in and out on the proof loading chains (15), in case of uneven embedding/tension on the anchors (10).

2. The method according to claim 1, wherein the anchors (10) are embedded on the seabed (14) using bollard pull from the vessel (6), or the anchors (10) are embedded on the seabed (14) using the tensioning winch (2), or a combination thereof.

3. The method according to claim 1, wherein the anchor (10) is installed with a bottom chain (17) which is connected to the proof loading chain (15) with a chain link (16).

4. The method according to claim 1, wherein after the first anchor (10) is embedded on the seabed, an initial embedding test is performed.

5. The method according to claim 1, wherein the proof loading test of the three-legged mooring system is performed using final tensioning of forces up to 800 te.

6. The method according to claim 1, wherein the proof loading test of the three-legged mooring system is performed using final tensioning of forces of 800 te or more.

7. The method according to claim 1, wherein the anchors (10) are deployed in their respective target box (18) and aligned with a respective mooring line corridor (19).

8. The method according to claim 7, wherein when performing tensioning, the vessel (6) moves closer towards the anchor (10) which is connected to the tensioning winch (2), and all three proof loading chains are aligning towards their respective target boxes (19).

9. The method according to claim 1, wherein in step d) the proof loading chain (15) is recovered up through the moonpool (1) until the first chain links are through the chain stopper (5), thereafter the chain stopper (5) is engaged and is taking over the load from the chain catenary of the proof loading chain (15), and the connection hook (11) is disconnected.

10. The method according to claim 9, wherein the extra length of proof loading chain is held in a chain locker (7,9), and said chain is routed from the locker (7) through the chain handling winch (3) and down towards the proof loading chain (15) in the chain stopper (5), hereafter the chain from the locker (7) is connected with the proof loading chain (15) using a chain link (13).

11. The method according to claim 1, wherein the mooring system is a three-legged mooring system with three anchors (10) on the seabed (14).

12. The method according to claim 11, wherein the method for tensioning the mooring system is repeated for a six-legged mooring system with six anchors (10) on the seabed (14).

13. The method according to claim 1, wherein the anchors (10) on the seabed (14) are placed with approximately 118-122 deg spread, preferably approximately a 120 deg spread.

* * * * *